US010767138B1

(12) United States Patent
Guerrero

(10) Patent No.: US 10,767,138 B1
(45) Date of Patent: Sep. 8, 2020

(54) COMPOSITION FOR ALL NATURAL MULTIPURPOSE CLEANER

(71) Applicant: Ivania Guerrero, Boca Raton, FL (US)

(72) Inventor: Ivania Guerrero, Boca Raton, FL (US)

( * ) Notice: Subject to any disclaimer, the term of this patent is extended or adjusted under 35 U.S.C. 154(b) by 0 days.

(21) Appl. No.: 16/353,464

(22) Filed: Mar. 14, 2019

(51) Int. Cl.

| | |
|---|---|
| ***C11D 1/66*** | (2006.01) |
| ***C11D 3/382*** | (2006.01) |
| ***C11D 3/20*** | (2006.01) |
| ***C11D 17/00*** | (2006.01) |
| ***C11D 3/50*** | (2006.01) |

(52) U.S. Cl.
CPC ..... *C11D 1/662* (2013.01); *C11D 3/201* (2013.01); *C11D 3/2086* (2013.01); *C11D 3/2096* (2013.01); *C11D 3/382* (2013.01); *C11D 3/50* (2013.01); *C11D 17/0008* (2013.01)

(58) Field of Classification Search
CPC ..... C11D 1/662; C11D 3/2079; C11D 3/382
See application file for complete search history.

(56) References Cited

U.S. PATENT DOCUMENTS 7,288,265 B1 * 10/2007 Rolf ..... A61K 9/7038 424/443
7,741,261 B1 * 6/2010 Guerrero ..... C11D 1/662 510/179

FOREIGN PATENT DOCUMENTS

WO WO-2009029046 A1 * 3/2009 ..... A61K 9/1075

* cited by examiner

*Primary Examiner* — Gregory R Delcotto
*Assistant Examiner* — Preeti Kumar
(74) *Attorney, Agent, or Firm* — Malloy & Malloy, P.L.; Robert M. Downey

(57) ABSTRACT

An all natural multipurpose cleaner composition includes: distilled water; lauryl glucoside (AG-60); aloe vera; vitamin E; ethyl alcohol (food grade); a preservative; and citric acid. Further embodiments of the composition include: tea tree oil; oregano; and a scent. The scent may include any of the following: lemon grass; cinnamon; sweet orange; rosemary; lemon and lime; pine; citronella; peppermint; eucalyptus; lavender; tea tree oil; and eucalyptus citriodora.

18 Claims, No Drawings

COMPOSITION FOR ALL NATURAL MULTIPURPOSE CLEANER

BACKGROUND OF THE INVENTION

Field of the Invention

The present invention relates to cleaning compositions and, more particularly, to compositions containing natural ingredients having good cleaning properties and which are both environmentally safe and hypoallergenic.

Discussion of the Related Art

The development and progression of cleaning formulations has always been focused on meeting the demands of the consumer. In the interest of always improving on previous cleaning formulations, most cleaners have, in the past, been created using an increasing number of synthetic (i.e., chemical) surfactants and solvents. While such synthetically formulated cleaners can be extremely effective at killing germs and cleaning surfaces, they also pose a significant danger to the consumer and the local environment. Many chemicals found in homes have been linked to allergies, cancer, birth defects and psychological abnormalities. Millions of pounds of these toxic ingredients are poured down drains each day and are not adequately removed by water treatment. These ingredients are returned to rivers and other water sources from which drinking water is obtained. The use of synthetic surfactants and solvents continues to leave consumers and the environment suffering the health consequences.

Because of the significant dangers posed by synthetic cleaners and the ever increasing desire for renewable resources, there has been an increased demand for entirely natural cleaning compositions. However, in the past, natural based cleaning compositions have suffered from at least one of two shortcomings. Those cleaning compositions that have used only all natural ingredients have failed to perform at the level of synthetically composed cleaners, forcing consumers to choose between their health or more effective cleaning. Other natural cleaning compositions have achieved similar performance to that of the synthetically composed cleaners, but only use several natural ingredients in combination with several synthetic surfactants and solvents. Cleaning compositions of this type merely slow and reduce the negative health and environmental effects of the toxic ingredients as opposed to eliminating them altogether.

Prior art cleaning compositions fail to combine entirely (i.e., exclusively) natural ingredients with effective cleaning that can be competitive with synthetic cleaners. Accordingly, there is an immediate need for a more effective natural cleaning composition which can compete with the top synthetic cleaners in terms of cleaning effectiveness and which can also be composed entirely of natural ingredients.

SUMMARY OF THE INVENTION

Before proceeding with the summary of the present invention, it is to be understood that unless otherwise stated, all percentages ("%'s") given are to be taken as percentage of total weight (percent by weight) of the entire composition. As an example, an embodiment containing 95% filtered water would have 95 grams of filtered water contained in every 100 grams of composition.

The present invention is directed to an all natural multipurpose cleaning composition which is both environmentally safe and hypoallergenic. One embodiment of the present invention comprises a natural multipurpose cleaning composition consisting essentially of Distilled Water, Lauryl Glucoside (AG-60), Aloe Vera, Vitamin E, Ethyl Alcohol (Food Grade), Preservative, and Citric Acid.

A second embodiment of the present invention comprises a natural multipurpose cleaning composition consisting essentially of Distilled Water, Lauryl Glucoside (AG-60), Aloe Vera, Vitamin E, Ethyl Alcohol (Food Grade), Preservative, Citric Acid, Tea Tree Oil, Lemon Grass Scent, and Oregano.

A third embodiment of the present invention comprises a natural multipurpose cleaning composition consisting essentially of Distilled Water, Lauryl Glucoside (AG-60), Aloe Vera, Vitamin E, Ethyl Alcohol (Food Grade), Preservative, Citric Acid, Tea Tree Oil, Cinnamon Scent, and Oregano.

A fourth embodiment of the present invention comprises a natural multi-purpose cleaning composition consisting essentially of Distilled Water, Lauryl Glucoside (AG-60), Aloe Vera, Vitamin E, Ethyl Alcohol (Food Grade), Preservative, Citric Acid, Tea Tree Oil, Sweet Orange Scent, and Oregano.

A fifth embodiment of the present invention comprises a natural multipurpose cleaning composition consisting essentially of Distilled Water, Lauryl Glucoside (AG-60), Aloe Vera, Vitamin E, Ethyl Alcohol (Food Grade), Preservative, Citric Acid, Tea Tree Oil, Rosemary Scent, and Oregano.

A sixth embodiment of the present invention comprises a natural multipurpose cleaning composition consisting essentially of Distilled Water, Lauryl Glucoside (AG-60), Aloe Vera, Vitamin E, Ethyl Alcohol (Food Grade), Preservative, Citric Acid, Tea Tree Oil, Lemon Scent, Lime Scent, and Oregano.

A seventh embodiment of the present invention comprises a natural multipurpose cleaning composition consisting essentially of Distilled Water, Lauryl Glucoside (AG-60), Aloe Vera, Vitamin E, Ethyl Alcohol (Food Grade), Preservative, Citric Acid, Tea Tree Oil, Pine Scent, and Oregano.

An eighth embodiment of the present invention comprises a natural multipurpose cleaning composition consisting essentially of Distilled Water, Lauryl Glucoside (AG-60), Aloe Vera, Vitamin E, Ethyl Alcohol (Food Grade), Preservative, Citric Acid, Tea Tree Oil, Citronella Scent, and Oregano.

A ninth embodiment of the present invention comprises a natural multipurpose cleaning composition consisting essentially of Distilled Water, Lauryl Glucoside (AG-60), Aloe Vera, Vitamin E, Ethyl Alcohol (Food Grade), Preservative, Citric Acid, Tea Tree Oil, Peppermint Scent, and Oregano.

A tenth embodiment of the present invention comprises a natural multipurpose cleaning composition consisting essentially of Distilled Water, Lauryl Glucoside (AG-60), Aloe Vera, Vitamin E, Ethyl Alcohol (Food Grade), Preservative, Citric Acid, Tea Tree Oil, Eucalyptus Scent, and Oregano.

An eleventh embodiment of the present invention comprises a natural multipurpose cleaning composition consisting essentially of Distilled Water, Lauryl Glucoside (AG-60), Aloe Vera, Vitamin E, Ethyl Alcohol (Food Grade), Preservative, Citric Acid, Tea Tree Oil, Lavender or Oregon Lavender Scent, and Oregano.

A twelfth embodiment of the present invention comprises a natural multipurpose cleaning composition consisting essentially of Distilled Water, Lauryl Glucoside (AG-60), Aloe Vera, Vitamin E, Ethyl Alcohol (Food Grade), Preservative, Citric Acid, Tea Tree Oil, Tea Tree Oil Scent, and Oregano.

A thirteenth embodiment of the present invention comprises a natural multipurpose cleaning composition consisting essentially of Distilled Water, Lauryl Glucoside (AG-60), Aloe Vera, Vitamin E, Ethyl Alcohol (Food Grade), Preservative, Citric Acid, Tea Tree Oil, Eucalyptus Citriodora Scent, and Oregano.

Objects and Advantages of the Invention

Considering the foregoing, it is a primary object of the present invention to provide a multipurpose cleaning composition composed of no less than 99.95% natural ingredients.

It is a further object of the present invention to provide a multipurpose cleaning composition composed of no less than 99.95% natural ingredients which is environmentally safe during storage, after application and after disposal.

It is still a further object of the present invention to provide a multipurpose cleaning composition as described above which is hypoallergenic.

It is still a further object of the present invention to provide a multipurpose cleaning composition as described above which is healthy to be inhaled or absorbed on the skin without causing negative health effects such as cancer, allergies, birth defects or psychological abnormalities.

It is still a further object of the present invention to provide several embodiments of a multipurpose cleaning composition as detailed above which can be competitive with the leading synthetically manufactured surface cleaning compositions.

It is still a further object of the present invention to provide several embodiments of a multipurpose cleaning composition as detailed above wherein the composition has a pleasant scent and contributes to the shine and pleasant appearance of a surface.

These and other objects of the present invention are more readily apparent with reference to the detailed description which follows.

DETAILED DESCRIPTION OF THE PREFERRED EMBODIMENTS

Before describing the present invention in detail, it is to be understood that the terminology used herein is for the purpose of describing particular embodiment of the invention only, and is not intended limit the spirit or scope of the invention in any manner.

Unless defined otherwise, all technical and scientific terms used herein have the same meaning as commonly understood by one of ordinary skill in the art to which the invention pertains. Although a number of materials and methods similar or equivalent to those described herein can be used in the practice of the present invention, the preferred materials and methods are described herein.

In the application, effective amounts are generally those amounts listed as the ranges or level of ingredients, as set forth in the following example formulations. Unless otherwise stated, amounts listed in percentage ("%'s") are in weight percent (based on 100% active) of the total weight of the cleaning composition. Example formulations of the multipurpose cleaner composition are set forth in detail below.

Example 1 (Unscented)

| Ingredient | Amount (% by Weight of the Composition) |
|---|---|
| Distilled Water | 94.47% |
| Lauryl Glucoside (AG-60) | 0.88% |
| Aloe Vera | 0.52% |
| Vitamin E | 0.04% |
| Ethyl Alcohol (Food Grade) | 3.99% |
| Preservative | 0.05% |
| Citric Acid | 0.05% |

Example 2 (Lemon Grass)

| Ingredient | Amount (% by Weight of the Composition) |
|---|---|
| Distilled Water | 94.40% |
| Lauryl Glucoside (AG-60) | 0.87% |
| Aloe Vera | 0.52% |
| Vitamin E | 0.03% |
| Ethyl Alcohol (Food Grade) | 3.96% |
| Preservative | 0.05% |
| Citric Acid | 0.05% |
| Tea Tree Oil | 0.01% |
| Lemon Grass Scent | 0.10% |
| Oregano | 0.005% |

Example 3 (Cinnamon)

| Ingredient | Amount (% by Weight of the Composition) |
|---|---|
| Distilled Water | 94.34% |
| Lauryl Glucoside (AG-60) | 0.87% |
| Aloe Vera | 0.52% |
| Vitamin E | 0.02% |
| Ethyl Alcohol (Food Grade) | 4.01% |
| Preservative | 0.05% |
| Citric Acid | 0.05% |
| Tea Tree Oil | 0.02% |
| Cinnamon Scent | 0.11% |
| Oregano | 0.004% |

Example 4 (Sweet Orange)

| Ingredient | Amount (% by Weight of the Composition) |
|---|---|
| Distilled Water | 94.40% |
| Lauryl Glucoside (AG-60) | 0.87% |
| Aloe Vera | 0.52% |
| Vitamin E | 0.03% |
| Ethyl Alcohol (Food Grade) | 3.96% |
| Preservative | 0.05% |
| Citric Acid | 0.05% |
| Tea Tree Oil | 0.02% |
| Sweet Orange Scent | 0.09% |
| Oregano | 0.003% |

Example 5 (Rosemary)

| Ingredient | Amount (% by Weight of the Composition) |
|---|---|
| Distilled Water | 94.42% |
| Lauryl Glucoside (AG-60) | 0.87% |
| Aloe Vera | 0.52% |
| Vitamin E | 0.02% |
| Ethyl Alcohol (Food Grade) | 3.95% |
| Preservative | 0.05% |
| Citric Acid | 0.05% |
| Tea Tree Oil | 0.02% |
| Rosemary Scent | 0.08% |
| Oregano | 0.003% |

Example 6 (Lemon and Lime)

| Ingredient | Amount (% by Weight of the Composition) |
|---|---|
| Distilled Water | 94.31% |
| Lauryl Glucoside (AG-60) | 0.87% |
| Aloe Vera | 0.52% |
| Vitamin E | 0.02% |
| Ethyl Alcohol (Food Grade) | 3.93% |
| Preservative | 0.05% |
| Citric Acid | 0.06% |
| Tea Tree Oil | 0.02% |
| Lemon Scent | 0.10% |
| Lime Scent | 0.10% |
| Oregano | 0.003% |

Example 7 (Pine)

| Ingredient | Amount (% by Weight of the Composition) |
|---|---|
| Distilled Water | 94.40% |
| Lauryl Glucoside (AG-60) | 0.88% |
| Aloe Vera | 0.52% |
| Vitamin E | 0.03% |
| Ethyl Alcohol (Food Grade) | 3.99% |
| Preservative | 0.05% |
| Citric Acid | 0.05% |
| Tea Tree Oil | 0.02% |
| Pine Scent | 0.06% |
| Oregano | 0.003% |

Example 8 (Citronella)

| Ingredient | Amount (% by Weight of the Composition) |
|---|---|
| Distilled Water | 94.41% |
| Lauryl Glucoside (AG-60) | 0.87% |
| Aloe Vera | 0.52% |
| Vitamin E | 0.03% |
| Ethyl Alcohol (Food Grade) | 3.98% |
| Preservative | 0.05% |
| Citric Acid | 0.05% |
| Tea Tree Oil | 0.02% |
| Citronella Scent | 0.07% |
| Oregano | 0.003% |

Example 9 (Peppermint)

| Ingredient | Amount (% by Weight of the Composition) |
|---|---|
| Distilled Water | 94.41% |
| Lauryl Glucoside (AG-60) | 0.87% |
| Aloe Vera | 0.52% |
| Vitamin E | 0.03% |
| Ethyl Alcohol (Food Grade) | 3.97% |
| Preservative | 0.05% |
| Citric Acid | 0.05% |
| Tea Tree Oil | 0.02% |
| Peppermint Scent | 0.08% |
| Oregano | 0.003% |

Example 10 (Eucalyptus)

| Ingredient | Amount (% by Weight of the Composition) |
|---|---|
| Distilled Water | 94.45% |
| Lauryl Glucoside (AG-60) | 0.87% |
| Aloe Vera | 0.52% |
| Vitamin E | 0.03% |
| Ethyl Alcohol (Food Grade) | 3.96% |
| Preservative | 0.05% |
| Citric Acid | 0.05% |
| Tea Tree Oil | 0.02% |
| Eucalyptus Scent | 0.04% |
| Oregano | 0.004% |

Example 11 (Lavender)

| Ingredient | Amount (% by Weight of the Composition) |
|---|---|
| Distilled Water | 94.44% |
| Lauryl Glucoside (AG-60) | 0.87% |
| Aloe Vera | 0.52% |
| Vitamin E | 0.03% |
| Ethyl Alcohol (Food Grade) | 3.93% |
| Preservative | 0.05% |
| Citric Acid | 0.05% |
| Tea Tree Oil | 0.02% |
| Lavender or Oregon Lavender Scent | 0.09% |
| Oregano | 0.003% |

Example 12 (Tea Tree Oil)

| Ingredient | Amount (% by Weight of the Composition) |
|---|---|
| Distilled Water | 94.37% |
| Lauryl Glucoside (AG-60) | 0.87% |
| Aloe Vera | 0.52% |
| Vitamin E | 0.02% |
| Ethyl Alcohol (Food Grade) | 3.94% |
| Preservative | 0.05% |
| Citric Acid | 0.05% |
| Tea Tree Oil | 0.02% |
| Tea Tree Oil Scent | 0.14% |
| Oregano | 0.004% |

Example 13 (Eucalyptus Citriodora)

| Ingredient | Amount (% by Weight of the Composition) |
|---|---|
| Distilled Water | 94.42% |
| Lauryl Glucoside (AG-60) | 0.87% |
| Aloe Vera | 0.52% |
| Vitamin E | 0.02% |
| Ethyl Alcohol (Food Grade) | 3.95% |
| Preservative | 0.05% |
| Citric Acid | 0.05% |
| Tea Tree Oil | 0.02% |
| Eucalyptus Citriodora Scent | 0.09% |
| Oregano | 0.003% |

In each of the above examples, the total amount of Lauryl Glucoside (AG-60) was dissolved in approximately 10% of the distilled water on a hot plate at 50 degrees Celsius while stirring for 5-10 minutes to produce a first mixture. The remaining amount of distilled water was combined with the remaining ingredients and stirred for approximately 5 minutes to produce a second mixture. The first mixture and the second mixture were then combined after the first mixture had cooled to room temperature while stirring for approximately 5 minutes to produce the final composition.

While the composition of the present invention has been described and exemplified according to several preferred embodiments thereof, it is recognized that departures from the instant disclosure are fully contemplated within the spirit and scope of the invention which is not to be limited except as defined in the following claims as interpreted under the Doctrine of Equivalents.

What is claimed is:

1. A composition for an all natural multipurpose cleaner comprising:

distilled water in an amount of between 92.00% and 96.00% by weight of the composition;

lauryl glucoside (AG-60) in an amount of between 0.85% and 0.90% by weight of the composition;

aloe vera in an amount of between 0.51% and 0.53% by weight of the composition;

vitamin E in an amount of between 0.02% and 0.04% by weight of the composition;

ethyl alcohol (food grade) in an amount of between 3.90% and 4.10% by weight of the composition;

a preservative in an amount of between 0.04% and 0.06% by weight of the composition; and citric acid in an amount of between 0.04% and 0.06% by weight of the composition.

2. The composition as recited in claim 1 further comprising tea tree oil in an amount of between 0.01% and 0.02% by weight of the composition.

3. The composition as recited in claim 2 further comprising oregano in an amount of between 0.003% and 0.004% by weight of the composition.

4. The composition as recited in claim 3 further comprising a scent in an amount of between 0.04% and 0.25% by weight of the composition.

5. The composition as recited in claim 4 wherein the scent is lemon grass.

6. The composition as recited in claim 4 wherein the scent is cinnamon.

7. The composition as recited in claim 4 wherein the scent is sweet orange.

8. The composition as recited in claim 4 wherein the scent is rosemary.

9. The composition as recited in claim 4 wherein the scent is lemon.

10. The composition as recited in claim 4 wherein the scent is lime.

11. The composition as recited in claim 4 wherein the scent is pine.

12. The composition as recited in claim 4 wherein the scent is citronella.

13. The composition as recited in claim 4 wherein the scent is peppermint.

14. The composition as recited in claim 4 wherein the scent is eucalyptus.

15. The composition as recited in claim 4 wherein the scent is lavender.

16. The composition as recited in claim 4 wherein the scent is oregon lavender.

17. The composition as recited in claim 4 wherein the scent is tea tree oil.

18. The composition as recited in claim 4 wherein the scent is eucalyptus citriodora.

* * * * *